US010907261B2

(12) United States Patent
Jeanty et al.

(10) Patent No.: US 10,907,261 B2
(45) Date of Patent: Feb. 2, 2021

(54) SYSTEM AND METHOD FOR THE ELECTROLYSIS OF CARBON DIOXIDE

(71) Applicant: Siemens Aktiengesellschaft, Munich (DE)

(72) Inventors: Philippe Jeanty, Munich (DE); Erhard Magori, Feldkirchen (DE); Christian Scherer, Unterschleißheim (DE); Angelika Tawil, Munich (DE); Kerstin Wiesner-Fleischer, Höhenkirchen-Siegertsbrunn (DE); Oliver von Sicard, Munich (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 16/312,263

(22) PCT Filed: May 18, 2017

(86) PCT No.: PCT/EP2017/061929
§ 371 (c)(1),
(2) Date: Dec. 20, 2018

(87) PCT Pub. No.: WO2018/001638
PCT Pub. Date: Jan. 4, 2018

(65) Prior Publication Data

US 2019/0256988 A1 Aug. 22, 2019

(30) Foreign Application Priority Data

Jun. 30, 2016 (DE) ..... 10 2016 211 822

(51) Int. Cl.
*C25B 3/04* (2006.01)
*C25B 15/08* (2006.01)
(Continued)

(52) U.S. Cl.
CPC ..... *C25B 3/04* (2013.01); *C25B 1/00* (2013.01); *C25B 9/10* (2013.01); *C25B 11/035* (2013.01); *C25B 15/08* (2013.01)

(58) Field of Classification Search
CPC .... C25B 1/00; C25B 3/04; C25B 9/10; C25B 11/035; C25B 15/08
See application file for complete search history.

(56) References Cited

U.S. PATENT DOCUMENTS 3,410,770 A 11/1968 Buechler ..... 205/628
3,679,565 A * 7/1972 Gilchrist ..... C02F 1/46 204/544
(Continued)

FOREIGN PATENT DOCUMENTS

CN 102190573 A 9/2011 ..... C07C 51/00
CN 103233240 A 8/2013 ..... B01D 53/32
(Continued)

OTHER PUBLICATIONS

German Office Action, Application No. 10 2016 211 822.6, 7 pages, dated Mar. 28, 2017.
(Continued)

*Primary Examiner* — Ciel P Contreras
(74) *Attorney, Agent, or Firm* — Slayden Grubert Beard PLLC

(57) ABSTRACT

Various embodiments include a system for carbon dioxide electrolysis comprising: an anode and a cathode both connected to a voltage supply, wherein the cathode comprises a gas diffusion electrode adjoined by a gas space and a cathode space; an electrolyte circuit; a gas supply delivering carbon dioxide to the gas space; wherein the gas space has an outlet for an electrolyte, carbon dioxide, and product gases produced by electrolysis; a return connection connecting the outlet to the gas supply; and a pump for circulation of carbon
(Continued)

dioxide and product gas in the gas space and the return connection.

10 Claims, 1 Drawing Sheet

(51) Int. Cl.

| | |
|---|---|
| ***C25B 9/10*** | (2006.01) |
| ***C25B 11/03*** | (2006.01) |
| ***C25B 1/00*** | (2006.01) |

(56) References Cited

U.S. PATENT DOCUMENTS

| | | | | |
|---|---|---|---|---|
| 4,892,637 | A | 1/1990 | Sauer et al. | 204/291 |
| 5,766,429 | A * | 6/1998 | Shimamune | C25B 1/46 204/257 |
| 2008/0223727 | A1* | 9/2008 | Oloman | B01D 53/326 205/413 |
| 2010/0180889 | A1* | 7/2010 | Monzyk | C25B 1/003 128/202.26 |
| 2012/0021302 | A1 | 1/2012 | Bulan et al. | 429/405 |
| 2012/0100442 | A1 | 4/2012 | Bulan et al. | 429/405 |
| 2014/0131217 | A1* | 5/2014 | Buschmann | C01B 7/01 205/440 |
| 2014/0291163 | A1* | 10/2014 | Kanan | C25B 3/04 205/555 |
| 2016/0068974 | A1 | 3/2016 | Oloman et al. | 205/338 |
| 2017/0175277 | A1* | 6/2017 | von Olshausen | C25B 1/12 |
| 2018/0023203 | A1* | 1/2018 | Hern ndez Alonso | B01J 23/70 204/157.15 |
| 2019/0136394 | A1* | 5/2019 | Edgar | C25B 15/02 |
| 2019/0233957 | A1 | 8/2019 | Jeanty et al. | |

FOREIGN PATENT DOCUMENTS

| | | | | |
|---|---|---|---|---|
| CN | 105316700 | A | 2/2016 | C25B 11/03 |
| DE | 10 2013 226 357 | A1 | 6/2015 | C25B 11/06 |
| EP | 0 297 377 | A2 | 1/1989 | B01J 23/34 |
| EP | 2 410 079 | A2 | 1/2012 | C25B 11/03 |
| EP | 2 444 526 | A2 | 4/2012 | C25B 11/03 |
| WO | 2014/138272 | A1 | 9/2014 | C25B 1/02 |
| WO | 2014/202854 | A1 | 12/2014 | C25B 1/04 |
| WO | 2015/139136 | A1 | 9/2015 | B01D 53/22 |
| WO | 2018/001638 | A1 | 1/2018 | C25B 1/00 |

OTHER PUBLICATIONS

International Search Report and Written Opinion, Application No. PCT/EP2017/061929, 34 pages, dated Jul. 4, 2017.

Chilean Office Action, Application No. 201803722, 17 pages, dated Jul. 15, 2019.

Chinese Office Action, Application No. 201780040305.7, 9 pages, dated May 14, 2020.

* cited by examiner

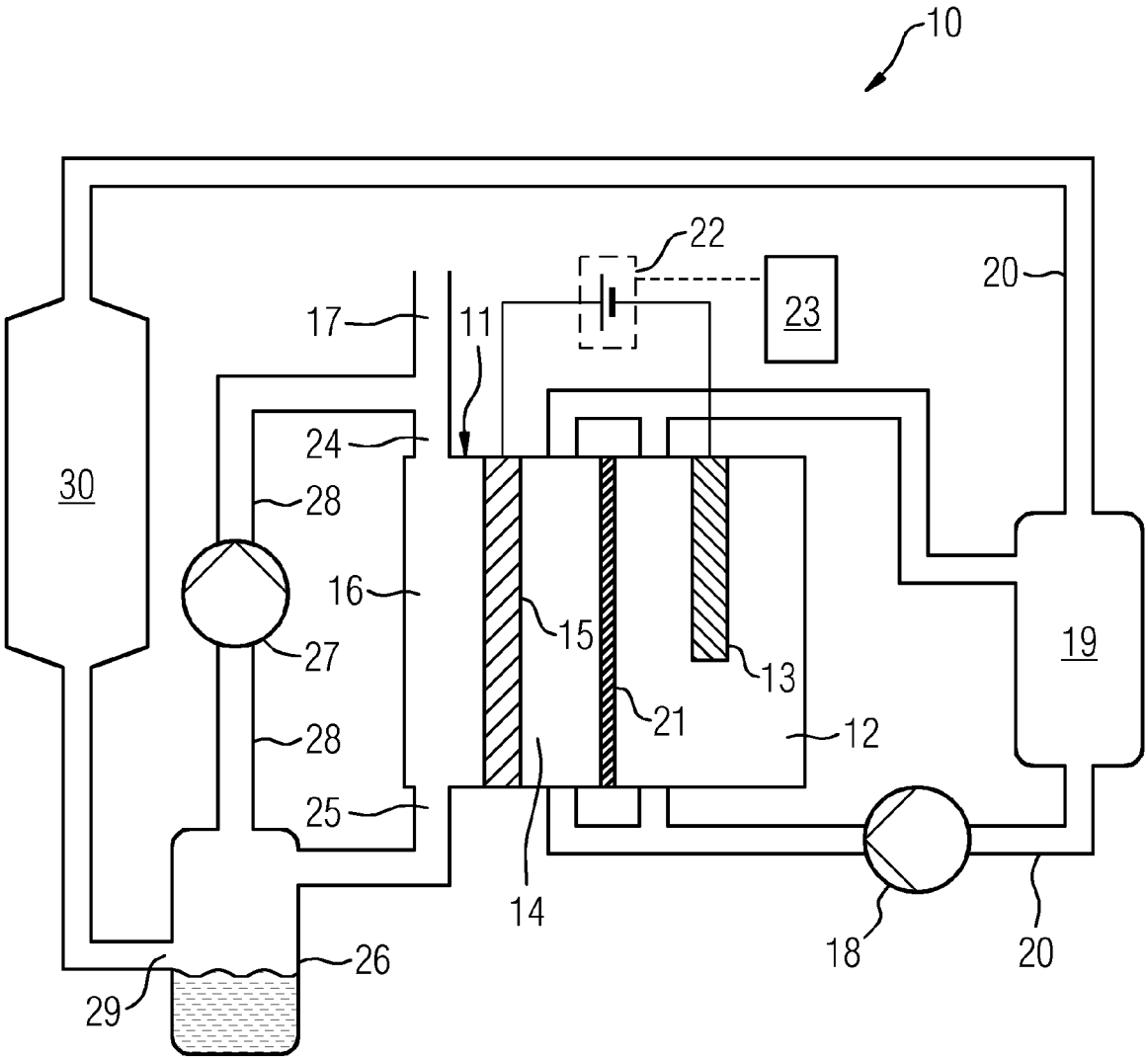
10
22
23
20
17
11
24
30
28
16
15
27
13
19
21
28
12
25
14
18
20
26
29

SYSTEM AND METHOD FOR THE ELECTROLYSIS OF CARBON DIOXIDE

CROSS-REFERENCE TO RELATED APPLICATIONS

This application is a U.S. National Stage Application of International Application No. PCT/EP2017/061929 filed May 18, 2017, which designates the United States of America, and claims priority to DE Application No. 10 2016 211 822.6 filed Jun. 30, 2016, the contents of which are hereby incorporated by reference in their entirety.

TECHNICAL FIELD

The present disclosure relates to carbon dioxide electrolysis. Various embodiments may include a system and/or a method for carbon dioxide electrolysis.

BACKGROUND

The combustion of fossil fuels currently provides about 80% of global energy demand. These combustion processes in 2011 emitted around 34 000 million tons of carbon dioxide (CO2) into the atmosphere globally. This release is the simplest way of disposing even of large volumes of CO2 (large brown coal power plants more than 50 000 t per day). Discussion about the adverse effects of the greenhouse gas CO2 on the climate has led to consideration of reutilization of CO2. CO2 is a strongly bonded molecule and can therefore be reduced back to usable products only with difficulty.

In nature, CO2 is converted to carbohydrates by photosynthesis. This complex process can be reproduced on the industrial scale only with very great difficulty. One currently technically feasible route is the electrochemical reduction of CO2. The carbon dioxide is converted here with supply of electrical energy to a product of higher energy value, for example CO, CH4, C2H4 or C1-C4 alcohols. The electrical energy in turn preferably comes from renewable energy sources such as wind power or photovoltaics.

For electrolysis of CO2, in general, metals are used as catalysts. The type of metal affects the products of the electrolysis. For example, CO2 is reduced virtually exclusively to CO over Ag, Au, Zn and, to a limited degree, over Pd and Ga, whereas a multitude of hydrocarbons are observed as reduction products over copper. As well as pure metals, metal alloys are also of interest, as are mixtures of metal and metal oxide having cocatalytic activity, since these can increase selectivity for a particular hydrocarbon.

In CO2 electrolysis, a gas diffusion electrode (GDE) can be used as cathode in a similar manner to that in chlor-alkali electrolysis in order to establish a three-phase boundary between the liquid electrolyte, the gaseous CO2 and the solid silver particles. This is done using an electrolysis cell as also known from fuel cell technology, having two electrolyte chambers, wherein the electrolyte chambers are separated by an ion exchange membrane. The working electrode is a porous gas diffusion electrode. It comprises a metal mesh, to which a mixture of PTFE, activated carbon, a catalyst and further components has been applied. It comprises a pore system into which the reactants penetrate and react at the three-phase interfaces.

The counterelectrode is sheet metal coated with platinum or a mixed iridium oxide. The GDE is in contact with the electrolyte on one side. On the other side it is supplied with CO2 which is forced through the GDE by positive pressure (called convective mode of operation). The GDE here may contain various metals and metal compounds that have a catalytic effect on the process. The mode of function of a GDE is known, for example, from EP 297377 A2, EP 2444526 A2 and EP 2410079 A2.

By contrast with chlor-alkali electrolysis and with fuel cell technology, the product formed in carbon dioxide electrolysis is gaseous and not liquid. In addition, the CO2 used forms salts with the alkali metal or alkaline earth metal hydroxide formed from the electrolyte. For example, when potassium salts are used as electrolytes, KOH is formed, and the salts KHCO3 and K2CO3 are formed. Owing to the operating conditions, there is crystallization of the salts in and on the GDE from the gas side.

The electrochemical conversion of CO2 over silver electrodes proceeds according to the following equation:

Cathode: $CO2+2e-+H2O \rightarrow CO+2OH—$ with the counter-reaction

Anode: $6H2O \rightarrow O2+4e-+4H3O+$

Owing to the electrochemical conditions, the charge in the chemical equations is not balanced uniformly with H30+ or OH—. In spite of acidic electrolyte, locally basic pH values occur at the GDE. For operation of alkaline fuel cell technology, the oxygen introduced has to be CO2-free since KHCO/K2CO3 would otherwise form according to the following equations:

$CO2+KOH \rightarrow KHCO3$ $CO2+2KOH \rightarrow K2CO3+H2O$

The same process is also observed in CO2 electrolysis, with the difference that the gas fed in cannot be CO2-free. As a result, after a finite time (depending on the current density), salt crystallizes in and on the GDE from the gas side and blocks the pores of the GDE. The gas pressure rises, the GDE is highly stressed and it tears over and above a particular pressure. Moreover, the potassium ions needed for the process are withdrawn from the process and the gas space is gradually filled with salt. An analogous process is also observed with other alkali metals/alkaline earth metals, for example cesium.

Stable long-term operation of the gas diffusion electrode in the region of more than 1000 h is not possible in CO2 electrolysis since the salt formed blocks the pores of the GDE and these thus become gas-impermeable.

SUMMARY

The teachings of the present disclosure may enable an improved system for carbon dioxide electrolysis and/or a method of operating an arrangement for carbon dioxide electrolysis, with which stable long-term operation is enabled with avoidance of the disadvantages mentioned at the outset. For example, some embodiments may include an arrangement (10) for carbon dioxide electrolysis, comprising: an electrolysis cell (11) having an anode (13) and a cathode (15), where anode (13) and cathode (15) are connected to a voltage supply (22), where the cathode (15) takes the form of a gas diffusion electrode adjoined on a first side by a gas space (16) and on a second side by a cathode space (14), an electrolyte circuit (20) that adjoins the electrolysis cell (11), a gas supply (17) for supplying carbon dioxide-containing gas to the gas space (16), characterized in that the gas space (16) has an outlet (25) for electrolyte, carbon dioxide and product gases from the electrolysis, the outlet (25) is connected via a return connection (28) to the gas supply (17), and a pump apparatus (27) is present for circulation of carbon dioxide and product gas in the circuit formed from the gas space (16) and the return connection (28).

In some embodiments, the pump apparatus (27) is disposed in the return connection (28).

In some embodiments, the pump apparatus (27) is disposed in the gas space (16).

In some embodiments, the pressure differential between gas space (16) and cathode space (14) is kept between 10 and 100 hPa.

In some embodiments, the outlet (25) in the gas space (16) is disposed at the bottom end.

In some embodiments, the outlet (25) is connected to an overflow vessel (26).

In some embodiments, the overflow vessel (26) is connected via a throttle (30) to the electrolyte circuit (20), where the throttle (30) is configured so as to bring about a definable pressure differential between gas space (16) and cathode space (14) when a mixture of product gases and liquid electrolyte flows through it.

In some embodiments, the throttle (30) comprises a pipe arranged at an angle of between 0° and 80° to the vertical.

In some embodiments, the pipe is in a rotatable arrangement.

In some embodiments, the gas space (16) has turbulence promoters.

In some embodiments, the turbulence promoters are configured such that an air gap of at least 0.1 mm remains between them and the surface of the cathode (15).

As another example, some embodiments include a method of operating an arrangement (10) for carbon dioxide electrolysis with an electrolysis cell (11) having an anode (13) and a cathode (15), where anode (13) and cathode (15) are connected to a voltage supply (22), where the cathode (15) takes the form of a gas diffusion electrode adjoined on a first side by a gas space (16) and on a second side by a cathode space (14), where carbon dioxide-containing gas is introduced into the gas space (16) by means of a gas feed (17), characterized in that an outlet (25) for electrolyte, carbon dioxide and product gases from the electrolysis is provided in the gas space (16), the outlet (25) is connected to the gas supply (17) to form a circuit, and the carbon dioxide and product gases are circulated by means of a pump apparatus (27).

In some embodiments, the pressure differential between gas space (16) and cathode space (14), by means of a throttle (30) between the outlet (25) and an electrolyte circuit (20), is kept within the interval from 10 hPa to 100 hPa.

BRIEF DESCRIPTION OF THE DRAWINGS

A working example embodiment of the teachings herein, but one which is by no means limiting, is now elucidated in detail with reference to the FIGURE in the drawing. The features are shown here in schematic form.

DETAILED DESCRIPTION

Some embodiments include a system for carbon dioxide electrolysis comprises an electrolysis cell having an anode and a cathode, where anode and cathode are connected to a voltage supply, where the cathode takes the form of a gas diffusion electrode adjoined on a first side by a gas space and on a second side by a cathode space, an electrolyte circuit that adjoins the electrolysis cell and a gas supply for supplying carbon dioxide-containing gas to the gas space.

In some embodiments, the gas space has an outlet for electrolyte, carbon dioxide and product gases from the electrolysis, the outlet is connected via a return connection to the gas supply, and there is a pump apparatus for circulation of carbon dioxide and product gas in the circuit formed from the gas space and the return connection.

In some embodiments, an arrangement for carbon dioxide electrolysis with an electrolysis cell having an anode and a cathode is used, anode and cathode are connected to a voltage supply, the cathode used is a gas diffusion electrode adjoined on a first side by a gas space and on a second side by a cathode space. In addition, carbon dioxide-containing gas is introduced into the gas space by means of a gas feed.

In some embodiments, an outlet for electrolyte, carbon dioxide and product gases from the electrolysis is provided in the gas space, the outlet is connected to the gas supply to form a circuit and the carbon dioxide and product gases are circulated by means of a pump apparatus. What is thus created is a carbon dioxide electrolysis plant that works in "flow-by" mode. The carbon dioxide is not forced here through the cathode, i.e. the gas diffusion electrode, to the catholyte side ("flow-through") but guided past it in the gas space. In addition, the carbon dioxide and product gases that are obtained in the electrolysis and released in the gas space are fed by means of the pump back to the gas stream at the inlet of the electrolysis cell. This achieves improved conversion of the carbon dioxide in the gas space and hence improved efficiency of the electrolysis.

The $OH^-$ ions that pass through the gas diffusion electrode do cause salt formation together with the carbon dioxide feed gas and the alkali metal cations from the electrolyte, but the pressure differential at the gas diffusion electrode is so small that sufficiently enough electrolyte is flushed through the gas diffusion electrode and brings the salt formed into solution, permanently washes it away and transports it out of the gas space. The flow-by mode prevents a pressure rise that would lead to crystallization of the salt formed.

In some embodiments, the following features can additionally be provided for the system:

- In some embodiments, the volume flow rate of the pump is distinctly greater than the feed gas volume flow rate, i.e. the volume flow rate of new carbon dioxide. This means that there is firstly high flow through the gas space, which in turn results in more turbulent flow; secondly, this improves the conversion of the carbon dioxide. Furthermore, the overflow from the gas space is transported away better owing to the higher gas flow rate.
- In some embodiments, the pump apparatus may be disposed within the gas space. For example, the pump apparatus may be disposed at the inlet to the gas space into which the gas feed opens or in the region of the outlet. The pump apparatus may, for example, be a membrane pump which is chemical-resistant. Other pump types are also useful, such as gear pumps, piston pumps, stroke pumps or peristaltic pumps. The volume flow rate of the pump apparatus may, for example, be 2 L/min to 5 L/min. It should be at least 10 times the volume flow rate of the incoming carbon dioxide.
- In some embodiments, the pump apparatus may be disposed in the return connection. In other words, the pump apparatus is disposed outside the gas space.
- In some embodiments, the outlet is disposed in the gas space at the bottom end. This means that the electrolyte that enters the gas space from the cathode space and runs off at the cathode to the bottom of the gas space can be conducted out of the gas space without difficulty.

In some embodiments, the outlet is connected to an overflow vessel. The outlet and any connected pipe conduct electrolyte and carbon dioxide and product gases. For the further work of the electrolysis cell, gases and electrolyte may be divided, which is accomplished by introduction into the overflow vessel. The electrolyte collects at the base of the overflow vessel, and the carbon dioxide and any product gases in the region above the electrolyte. Appropriately, the return connection to the gas feed is connected in the upper region of the overflow vessel, such that the carbon dioxide can be recycled without electrolyte. The electrolyte is guided to the overflow vessel preferably in a gravity-driven manner.

The overflow vessel may be constructed separately from the gas space and may be connected, for example, via a pipe connection. The overflow vessel may also be integrated into the gas space.

In some embodiments, the overflow vessel may be connected to the electrolyte circuit via a throttle configured to bring about a definable pressure differential between gas space and cathode space. The pressure differential is not to be dependent on whether gas, electrolyte or a mixture thereof is passing through the throttle. This keeps the pressure differential within a predetermined range. As a result, a constant flow of electrolyte through the gas diffusion electrode into the gas space is maintained, which prevents salting-up, but on the other hand limits the flow of the electrolyte in order to prevent coverage of the gas diffusion electrode with a liquid film that would reduce the efficiency of the electrolysis. The throttle may be disposed, for example, at a moderate height in the overflow vessel. As soon as the liquid level in the overflow vessel reaches this moderate height, the electrolyte is transported away through the throttle. The liquid level in the overflow vessel is thus kept constant at the moderate height.

In some embodiments, the throttle may encompass a pipe arranged at an angle of between 0° and 80° to the vertical. In one configuration, the throttle comprises a vertical pipe. The pipe may have a length of between 60 cm and 140 cm, especially between 90 cm and 110 cm.

In some embodiments, the pipe may be in a rotatable arrangement. This allows alteration of the absolute height that the pipe bridges. As a result, in turn, the pressure differential brought about by the pipe is altered. It is thus possible to establish a desired pressure differential between gas space and cathode space by a rotation of the pipe. The maximum pressure differential exists when the pipe is vertical. If the pipe is rotated to the horizontal, the pressure differential is close to zero.

In some embodiments, a first pressure sensor may be present in the gas space. This gives a pressure signal, for example, to a control device for actuation of the shut-off device. A second pressure sensor may be disposed within the cathode space. This can likewise give a pressure signal to the control device. The two pressure signals can be used by the control device to determine the pressure differential.

In some embodiments, a pressure differential sensor for gas space and cathode space may be present. This directly gives a signal for the pressure differential to a control device.

In some embodiments, the pressure differential between gas space and cathode space may be kept between 10 and 100 hPa. This slight pressure increase on the gas side still permits sufficiently good passage of the electrolyte through the gas diffusion electrode, i.e. washes the salts away efficiently, and simultaneously moves the three-phase boundary somewhat into the gas diffusion electrode. What is thus used is a modified flow-by operation in which the reactant gas is forced slightly into the gas diffusion electrode. This increases the yield of product gas, for example carbon monoxide.

In some embodiments, the gas space may comprise turbulence promoters. The electrolysis takes place in flow-by operation, meaning that the carbon dioxide is guided past the gas diffusion electrode and is not forced through it. Without additional internals, a laminar flow thus develops, in which the gas velocity is very low at the surface of the gas diffusion electrode. The gas space is therefore remodeled such that the incoming gas is vortexed and hence the flow film at the surface of the cathode breaks. This results in better penetration of the carbon dioxide into the gas diffusion electrode and hence in a better yield of product gas, for example CO. Turbulence promoters may include, for example: flow channel, baffle, reduction in the cross section.

In some embodiments, the turbulence promoters may be configured such that an air gap of between 0.1 mm and 5 mm remains between them and the surface of the cathode. In some embodiments, electrolyte passing through the gas diffusion electrode does not wet and is not retained at the turbulence promoters. This in turn would lead to a reduced flow of carbon dioxide and would significantly damage the efficiency of the electrolysis overall. However, the air gap creates a separation of the turbulence promoters from the surface of the gas diffusion electrode, such that the electrolyte can run off and collect at the bottom end in the gas space. However, there may be supporting connections at multiple points between the turbulence promoters and the gas diffusion electrode, which means that the gas diffusion electrode experiences mechanical reinforcement.

The turbulence promoters may have efflux channels, by means of which the electrolyte is guided to the edge of the gas space.

The construction of an electrolysis cell 11 shown in schematic form in the FIGURE is suitable for undertaking a carbon dioxide electrolysis. This embodiment of the electrolysis cell 11 comprises at least one anode 13 with an adjoining anode space 12, and a cathode 15 and an adjoining cathode space 14. Anode space 12 and cathode space 14 are separated from one another by a membrane 21. The membrane 21 is typically manufactured from a PTFE-based material. According to the electrolyte solution used, a construction without a membrane 21 is also conceivable, in which case pH balancing then goes beyond that by the membrane 21.

Anode 13 and cathode 15 are electrically connected to a voltage supply 22 which is controlled by the control unit 23. The control unit 23 may apply a protection voltage or an operating voltage to the electrodes 13, 15, i.e. the anode 13 and the cathode 15. The anode space 12 of the electrolysis cell 11 shown is equipped with an electrolyte inlet. The anode space 12 depicted likewise comprises an outlet for electrolyte and, for example, oxygen $O_2$ or another gaseous by-product which is formed in the carbon dioxide electrolysis at the anode 13. The cathode space 14 in each case likewise has at least one product and electrolyte outlet. The overall electrolysis product may be composed of a multitude of electrolysis products.

The electrolysis cell 11 is also executed in a three-chamber construction in which the carbon dioxide $CO_2$ is introduced into the cathode space 14 via the cathode 15 executed as a gas diffusion electrode. Gas diffusion electrodes enable mutual contacting of a solid catalyst, a liquid electrolyte and a gaseous electrolysis reactant. For this purpose, for example, the catalyst may be executed in porous form and assume the electrode function, or a porous electrode assumes the catalyst function. The pore system of the electrode is configured here such that the liquid phase and the gaseous phase can penetrate equally into the pore system and may be present simultaneously therein, i.e. at the electrically accessible surface thereof. One example of a gas diffusion electrode is an oxygen-depolarized electrode which is used in chloralkali electrolysis.

For configuration as a gas diffusion electrode, the cathode 15 in this example comprises a metal mesh to which a mixture of PTFE, activated carbon and a catalyst has been applied. For introduction of the carbon dioxide CO2 into the catholyte circuit, the electrolysis cell 11 comprises a carbon dioxide inlet 24 into the gas space 16. In the gas space 16, the carbon dioxide reaches the cathode 15, where it can penetrate into the porous structure of the cathode 15 and hence be reacted.

In addition, the arrangement 10 comprises an electrolyte circuit 20, by means of which the anode space 12 and the cathode space 14 are supplied with a liquid electrolyte, for example K2SO4, KHCO3, KOH, Cs2SO4, and the electrolyte is recycled into a reservoir 19. The electrolyte is circulated in the electrolyte circuit 20 by means of an electrolyte pump 18.

In some embodiments, the gas space 16 comprises an outlet 25 disposed in the base region. The outlet 25 is configured as an opening with sufficient cross section, so that both electrolyte that passes through the cathode 15 and carbon dioxide and product gases can get through the outlet into the connecting pipe. The outlet 25 leads to an overflow vessel 26. The liquid electrolyte is collected and accumulates in the overflow vessel 26. Carbon dioxide and product gases that come from the gas space 16 are separated from the electrolyte and accumulate above it.

From a point toward the top of the overflow vessel 26, a further pipe 28 leads to a pump 27, in this working example a membrane pump, and further to the gas supply 17. The pump 27 may also be a piston pump, stroke pump, extruder pump or gear pump. Part of the gas supply 17, the gas space 16, the pipe 18 and the overflow vessel 26 together with the connection thereof to the outlet 25 thus together form a circuit. By means of the pump 27, the carbon dioxide and product gases present are guided from the overflow vessel 26 back into the gas supply and hence the gas is partly circulated. The volume flow rate of the pump 27 is much higher than the volume flow rate of new carbon dioxide. Reactant gas that has not been consumed is thus advantageously guided once again past the cathode 15 and once more or more than once has the opportunity to be reduced. Product gases are likewise partly circulated here. The repeated passage of the carbon dioxide past the cathode 15 increases the efficiency of the conversion.

From the overflow vessel 26, there is a further connection that leads back to the electrolyte circuit 20. This connection begins with an outlet 29 disposed at a side wall of the overflow vessel 26, preferably close to the base, but not at the base. The outlet 29 is connected to a throttle 30 in the form of a vertical pipe section having a length of 90 cm, for example. The diameter of this pipe section is much greater than that of the inlets to the throttle 30. The inlet has, for example, an internal diameter of 4 mm; the pipe has an internal diameter of 20 mm. The throttle 30 is connected on the outlet side, i.e. at the upper end of the pipe section, to the electrolyte circuit 20.

In continuous operation, the throttle 30 establishes and maintains a pressure differential between the electrolyte circuit 20 connected at the top end and hence also the cathode space 14 on the one hand and the overflow vessel 26 and the gas space 16 on the other hand. This pressure differential is between 10 and 100 hPa (mbar), meaning that the gas space 16 remains at only slightly elevated pressure relative to the cathode space 14. In some embodiments, the throttle 30 establishes the pressure differential irrespective of whether a liquid or gaseous medium is currently flowing through, or a mixture thereof. In the pipe section of the throttle 30 filled with electrolyte, the pressure differential is established depending on the height of the pipe section, owing to the hydrostatic pressure. If the pipe section is mounted in a rotatable manner, the pressure differential of the throttle 30 can be lowered in an infinitely variable manner, down to virtually zero in a horizontal position.

When starting up the electrolysis, in spite of the slightly elevated pressure on the gas side, i.e. in the gas space 16, the electrical voltage applied to the cathode 15 results in "pumping" of electrolyte out of the catholyte space 14 through the gas diffusion electrode, i.e. the cathode 15, in the direction of gas space 16. Droplets form on the side of the gas space 16 at the surface of the cathode 15, which coalesce and collect in shape in the lower region of the cathode 15.

As a result, the backup of electrolyte causes a pressure rise in the gas space 16. However, this pressure rise is compensated for again by the throttle 30 in that electrolyte and/or gas is recycled from the overflow vessel 26 back into the electrolyte circuit 20. The pressure differential between the two sides of the cathode 15 thus remains within the desired range between 10 and 100 hPa.

The $OH^-$ ions that pass through the cathode 15 do cause salt formation together with the carbon dioxide and the alkali metal cations from the electrolyte, but the pressure differential at the cathode 15 is so small that sufficient liquid is flushed through the cathode 15 and brings the salt formed into solution, permanently washes it away and transports it out of the gas space 16 into the overflow vessel 26. A further pressure rise that would lead to crystallization of the salt formed is prevented by the throttle 30.

The invention claimed is:

1. A system for carbon dioxide electrolysis, the system comprising:

an electrolysis cell having an anode and a cathode both connected to a voltage supply, wherein the cathode comprises a gas diffusion electrode adjoined on a first side by a gas space and on a second side by a cathode space;

an electrolyte circuit adjoining the electrolysis cell, the electrolyte circuit supplying an electrolyte to an anode space and to the cathode space and receiving a least a portion of the electrolyte from the anode space and from the cathode space;

a gas supply delivering carbon dioxide-containing gas to the gas space; wherein the gas space has an outlet for the electrolyte passing through the gas diffusion electrode from the cathode space, carbon dioxide, and product gases produced by the electrolysis cell;

a return connection connecting the outlet to the gas supply;

a pump for circulation of carbon dioxide and product gas in the gas space and the return connection; and a throttle disposed in a line between the cathode space and the gas space, the throttle limiting a pressure differential between the gas space and the cathode space.

2. The system as claimed in claim 1, wherein the pump is disposed in the return connection.

3. The system as claimed in claim 1, wherein the pump is disposed in the gas space.

4. The system as claimed in claim 1, wherein the throttle maintains the pressure differential between the gas space and the cathode space between 10 and 100 hPa.

5. The system as claimed in claim 1, wherein the outlet is disposed at a bottom end of the gas space.

6. The system as claimed in claim 1, wherein the outlet connects to an overflow vessel.

7. The system as claimed in claim 1, wherein the throttle comprises a pipe arranged at an angle of between 0° and 80° to the vertical.

8. The system as claimed in claim 7, wherein the pipe is rotatable to set the angle to the vertical.

9. The system as claimed in claim 1, further comprising turbulence promoters disposed in the gas space.

10. The system as claimed in claim 9, wherein the turbulence promoters define an air gap of at least 0.1 mm between the turbulence promoters and a surface of the cathode.

* * * * *